US005078863A

United States Patent [19]

Durigon

[11] Patent Number: 5,078,863

[45] Date of Patent: Jan. 7, 1992

[54] POOL SKIMMER

[76] Inventor: Duilio Durigon, 61 Homestead Road, Rau Marais Park, Sandton, Transvaal, South Africa

[21] Appl. No.: 347,718

[22] Filed: May 4, 1989

[30] Foreign Application Priority Data

May 5, 1988 [ZA] South Africa ..... 88/3218

[51] Int. Cl.[5] ..... E04H 4/16

[52] U.S. Cl. ..... 210/123; 210/169; 210/242.1; 210/416.2

[58] Field of Search ..... 210/123, 127, 169, 242.1, 210/416.2, 776

[56] References Cited

U.S. PATENT DOCUMENTS

| | | | |
|---|---|---|---|
| 3,212,268 | 10/1965 | Ortega | 210/169 |
| 3,555,574 | 1/1971 | Stanwood | 210/169 |
| 3,970,556 | 7/1976 | Gore | 210/242.2 |
| 4,325,150 | 4/1982 | Buddy | 210/169 |
| 4,743,368 | 5/1988 | Gates | 210/169 |
| 4,746,424 | 5/1988 | Drew | 210/169 |
| 4,818,389 | 4/1989 | Tobias et al. | 210/169 |
| 4,826,591 | 5/1989 | Macia | 210/169 |

FOREIGN PATENT DOCUMENTS 312759 4/1989 European Pat. Off. .

*Primary Examiner*—Stanley S. Silverman
*Assistant Examiner*—Christopher Upton
*Attorney, Agent, or Firm*—Ladas & Parry

[57] ABSTRACT

This invention relates to a pool skimmer which is adapted to remove floating fractions, such as floating debris, from the surface of water. The pool surface skimmer of the invention comprises a housing within which a strainer separates a high level inlet from a low level outlet. The inlet is adapted to float below the surface of the water by means of two or more flotation chambers defining, between them, one or more intake ports each closable by means of a gate which is adapted to allow the ingress of water from the surface of the pool upon withdrawal of water from the outlet of the housing. The strainer is complemental, in outline shape, to the inlet cavity at the water surface and the gates are located closely adjacent the housing wall defining the inlet cavity of the apparatus. It is therefore possible, by removal of the strainer, to clear the entire water surface of the inlet cavity for removal or reclamation of the floating fraction separated in this manner.

5 Claims, 9 Drawing Sheets

FIG. 1
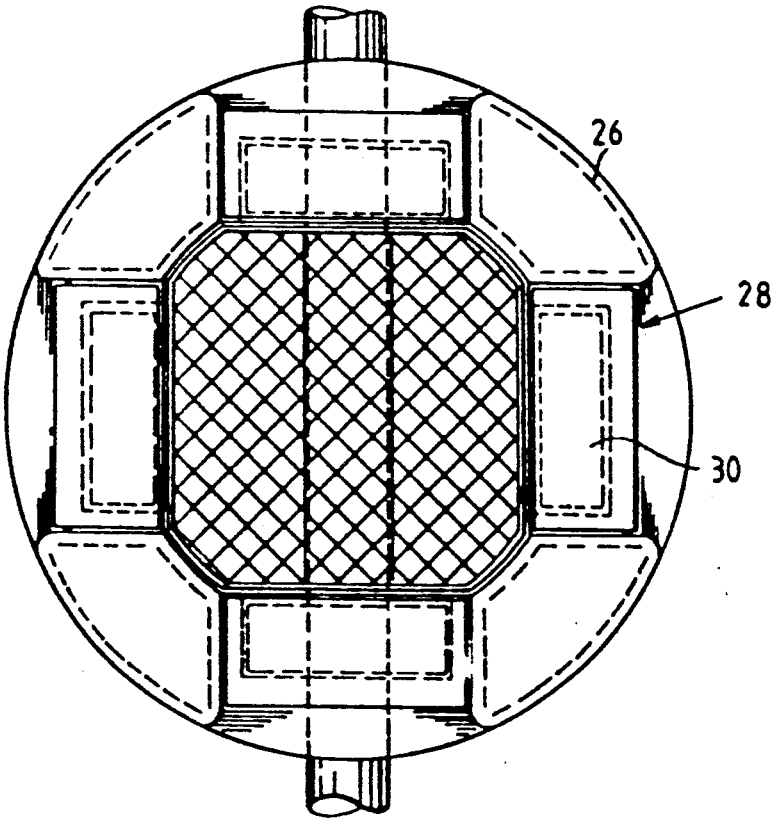
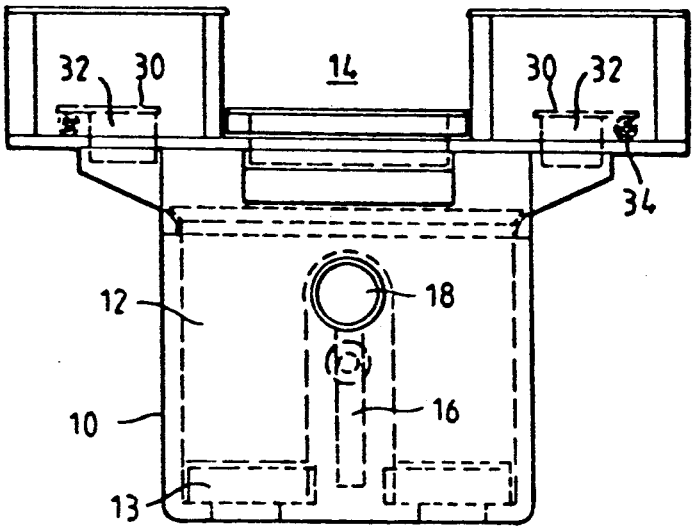
FIG. 2

FIG. 5
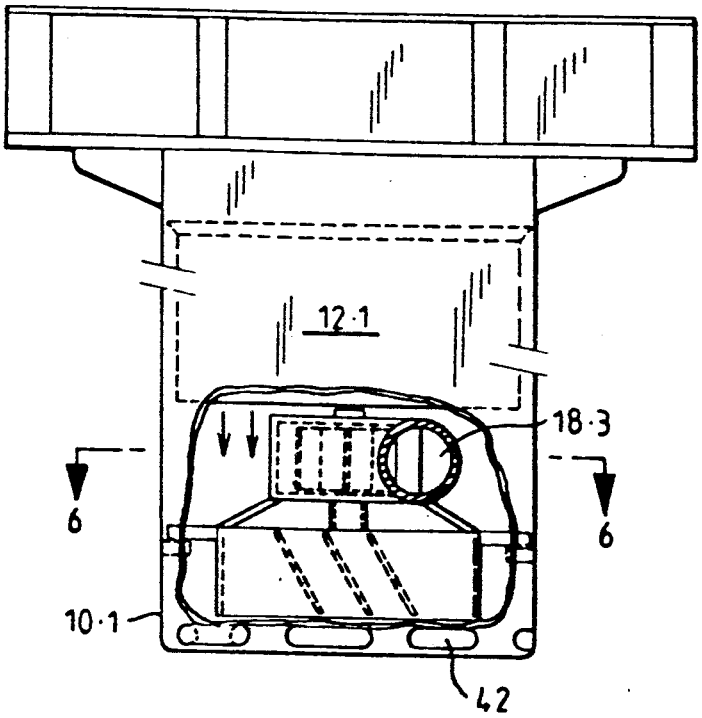
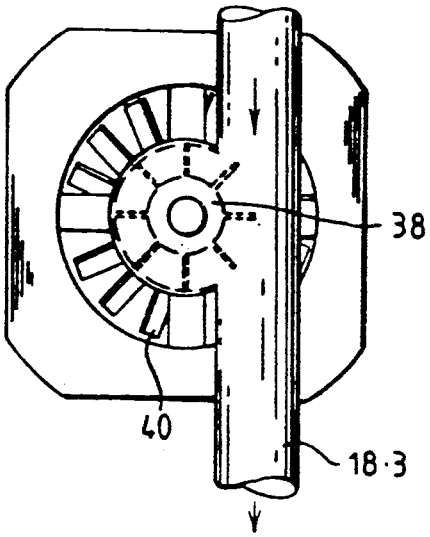
FIG. 6

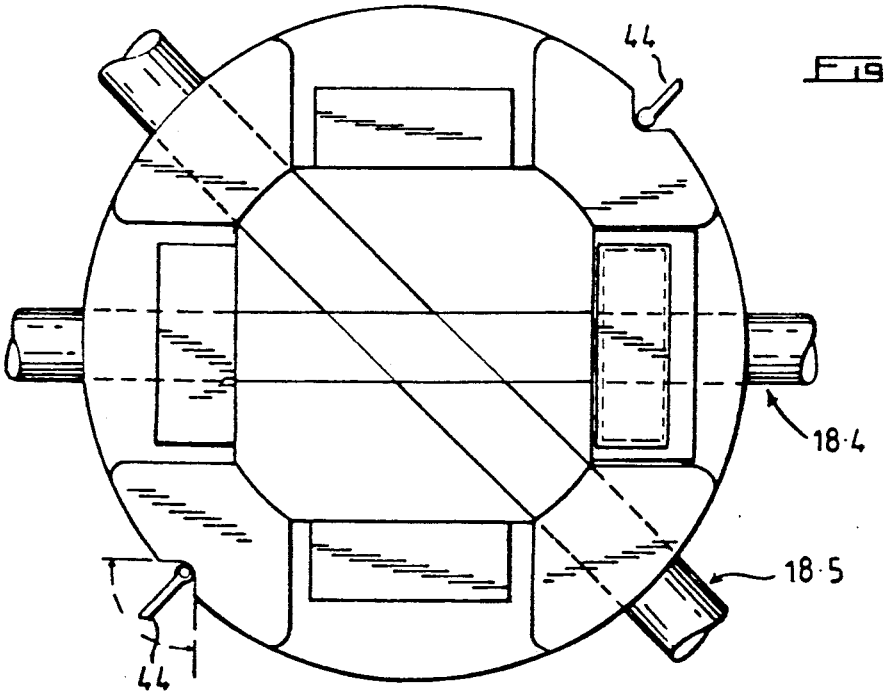
FIG. 7
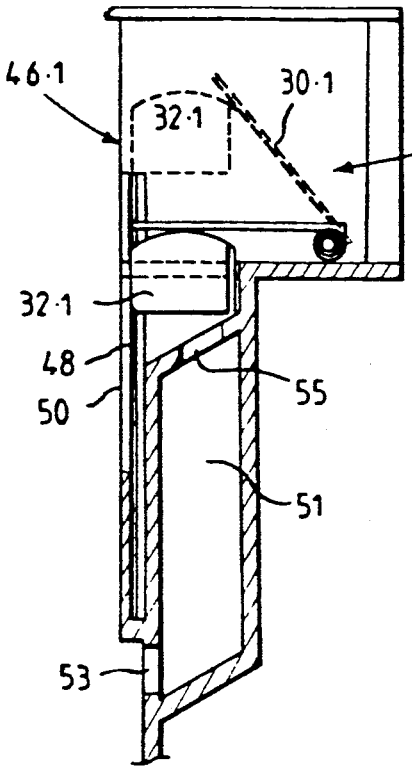
FIG. 8
FIG. 10
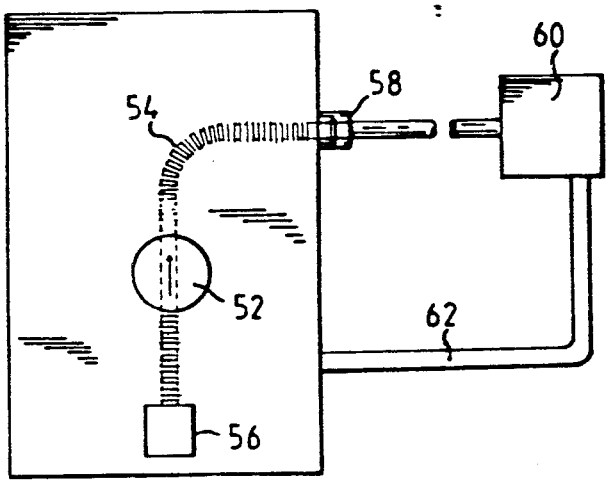

Fig. 14
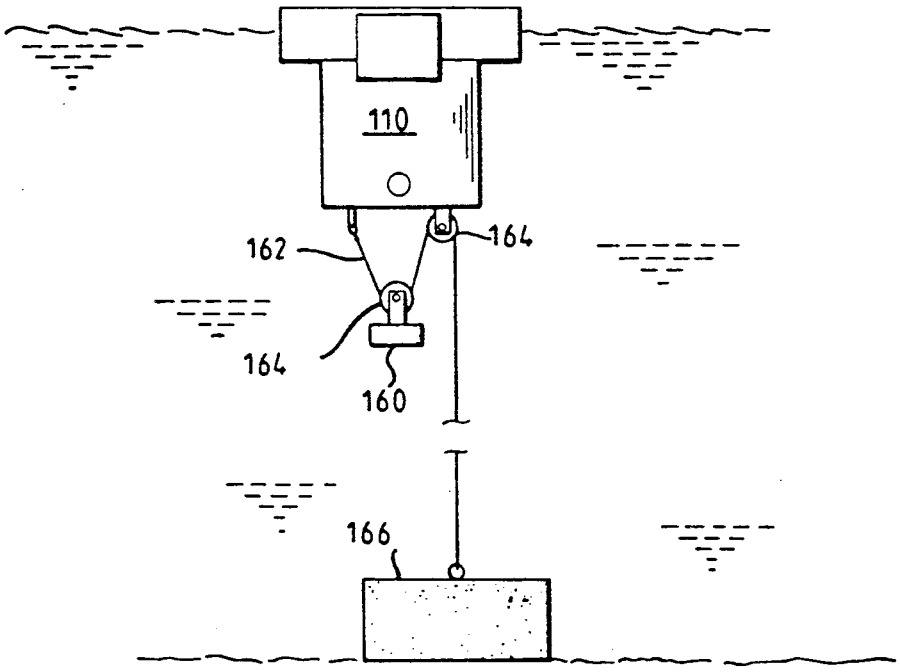
Fig. 15
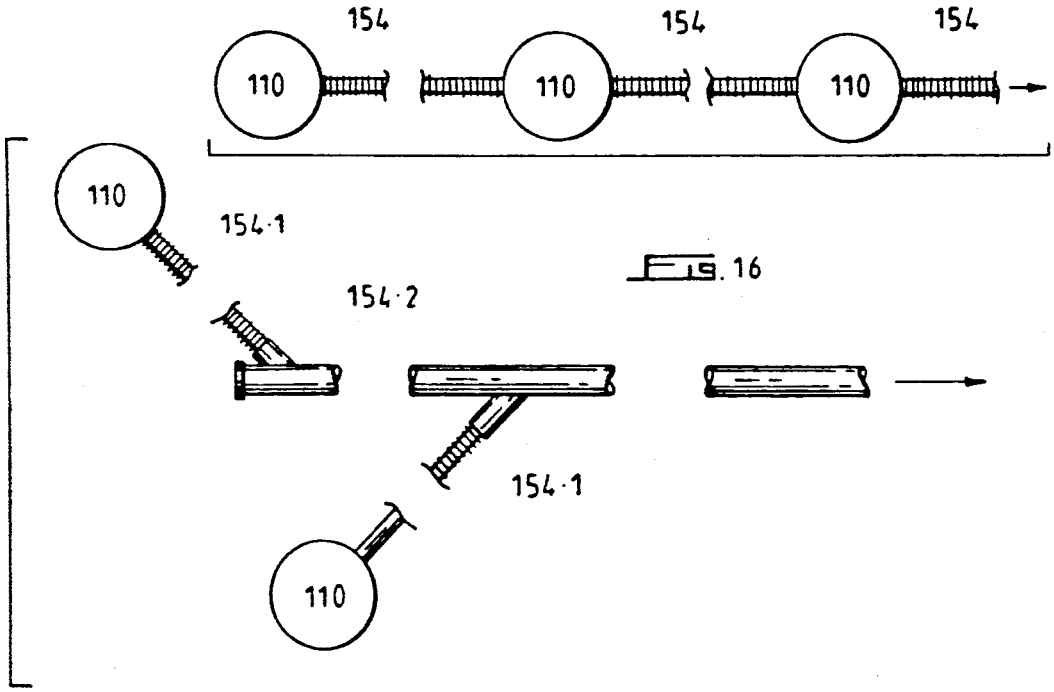
Fig. 16

POOL SKIMMER

BACKGROUND TO THE INVENTION

This invention relates to a pool skimmer which is adapted to remove floating fractions, such as floating debris, from the surface of water.

This invention has industrial applications, such as in the separation of a floating fraction from the surface of a pool of liquid. The invention can also be applied agriculturally or environmentally, such as in the removal of floating contaminants from dams, ponds and the ocean surface. However, the simplest and most illustrative application of the invention is in the removal of floating debris, such as leaves and dead insects from the surface of a swimming pool. The invention will therefore be described with reference to such an application, but it will be appreciated that this is purely exemplary and it is not intended to limit the scope of the invention in any way.

Floating pool skimmers with weir operated inlets are known.

See for instance U.S. Pat. No. 3,970,556—Gore—which describes a skimmer including an outer, annular body with an inner cavity. Flotation and ballast chambers in the outer body regulate the level of floatation of a weir operated inlet. The liquid is pumped out of the central cavity through a drain opening in the base plate and a moveable weir extends across the width of the inlet opening to regulate the quantity and velocity of liquid which flows through the opening and into the central cavity. The outer edge of the weir is connected to the body by a hinge connection which permits the weir to articulate and a float is mounted beneath the weir, so that the weir floats on the liquid within the central cavity, with the outer edge of the weir elevated. This produces a cascade of liquid over the upper edge of the weir which, in turn, produces regulated skimming of the surface of the liquid by the cascade action.

In skimmer applications, as exemplified by Gore, the floating fraction, such as the leaves, insects and other debris, is drawn directly into the filter system, which is often undesirable. In more complex skimmer systems the water surface within the interior cavity of the device is not matched to the shape of the strainer. The disadvantage of such an arrangement is that, upon removal of suction from the device, to clean the strainer, the floating debris returns to the surface of the liquid within the inner cavity. Upon removal of the strainer from this cavity, a large proportion of the floating debris is left within the cavity and is not removed by removal of the strainer. Once again, this places an undesirable load on the pool filter system, which the skimmer is intended to alleviate, so that it can be seen that the skimmer does not perform, adequately, the function it is intended to.

SUMMARY OF THE INVENTION

The pool surface skimmer of the invention comprises a housing within which a strainer separates a high level inlet from a low level outlet, the skimmer housing being adapted for in-line connection to the suction hose of pool suction apparatus in such a manner that water flow in the hose induces suction at the outlet, the inlet being adapted to float below the surface of the water by means of two or more flotation chambers defining, between them, one or more intake ports each closable by means of a gate which is adapted to allow the ingress of water from the surface of the pool upon withdrawal of water through the outlet, wherein the strainer is complemental, in outline shape, to the inlet cavity at the water surface and that the gates are located closely adjacent the housing wall defining the inlet cavity of the apparatus.

The strainer may be removable for cleaning and in the preferred form of the invention is constituted by a removable basket.

In this manner it is possible, by removal of the strainer for instance, to clear the entire water surface of the inlet cavity for removal or reclamation of the floating fraction separated in this manner, i.e. the leaves, dead insects or other floating debris in the example.

The float operated weirs may be constituted by sliding gates which are adapted to slide in slideways located adjacent the wall defining the inlet cavity in the housing.

In one form of the invention, the gates are located in slideways formed in the housing and in another form of the invention, the gates are located in slideways formed in a basket constituting the strainer.

In the latter form of the invention, the gates may be provided with means to keep the gates closed when the strainer is withdrawn from the inlet cavity, for instance to clean the strainer.

The closing means for the gates may be constituted by handles for the strainer basket which are adapted to engage the gates in such a manner that the gates are retained in a closed position when, in use the handles are drawn upwardly, for instance, to remove the strainer basket from the inlet cavity of the housing.

The weir arrangement may conveniently be constituted by a cover flap which is pivoted, at its base and adapted at its free end, to overlie a float located at a high point on the float operated gate, the control flap being adapted to impinge on the float operated gate, under urging of water spilling over the control flap, in use, to impinge on the gate in a direction axially in line with the slideway.

This arrangement is intended to minimise the possibility of binding of the gate within the slideway and to prevent debris from fouling the slideways. In this manner, the floats, gates and slideways remain free of debris.

Suction may be induced at the outlet in any one of a number of known ways, such as, for instance, by means of a side tube which is open to the interior of an in-line tube adapted for connection to the suction hose.

Alternatively, an aperture plate or venturi arrangement could be used.

The pool surface skimmer may include a housing with a high level inlet and a low level outlet, a rotor impeller and, located within the housing between the inlet and the outlet, a strainer and a rotor which is adapted, upon rotation, to draw water from the inlet end through the strainer and to expel the water through the outlet, the housing being adapted for in-line connection to the suction hose of pool suction apparatus in such a manner that water flowing through the suction hose impinges on the impeller to rotate the impeller and rotor and the inlet being adapted to float just below the surface of the water by means of two or more floats defining between them, one or more intake ports, each closable by means of a float operated weir which is adapted to allow the ingress of water from the surface of the pool upon expulsion of water through the outlet.

The rotor can be a turbine-type rotor, a screw-type rotor or any suitable water propeller.

The rate of water throughput through the skimmer may be variable by means of a manual control such as a suction control on the first example or a variable choke vane on the second example.

DESCRIPTION OF THE DRAWINGS

Embodiments of the invention are described below with reference to the accompanying drawings in which FIGS. 1 to 7 illustrate known aspects of pool skimmers by way of background information; and in which:

FIG. 1 is a plan view on a first example of a skimmer;

FIG. 2 is a side elevation on the skimmer of FIG. 1;

FIG. 3 is a plan view on a combined cover and water deflector useful with the skimmer of FIG. 1;

FIG. 4 is a side elevation illustrating the use of the cover of FIG. 4;

FIG. 5 is a side elevation, partly in section, of a second example of a skimmer;

FIG. 6 is a plan section on a line 6—6 in FIG. 5;

FIG. 7 is a plan view on either of the abovementioned examples, illustrating alternative suction hose orientations;

FIG. 8 is a diagrammatic section illustrating details of a float operated weir gate arrangement in accordance with the invention;

FIG. 10 is a general diagrammatic plan illustrating one method of the operation of the apparatus in a swimming pool;

FIG. 11 (*b*) is a sectional plan view of the lower portion of an alternative version of the skimmer of FIG. 11 (*a*);

FIG. 11 (*c*) is a partial sectional elevation of the alternative version of the skimmer of FIG. 11 (*b*);

FIG. 14 is a diagrammatic section illustrating the skimmer apparatus of the invention in use industrially or agriculturally;

FIG. 15 illustrates an in-series or in-line arrangement of a plurality of skimmers according to the invention;

FIG. 16 illustrates a branched parallel arrangement of skimmers; and

DESCRIPTION OF EMBODIMENTS OF THE INVENTION

Figure 3:
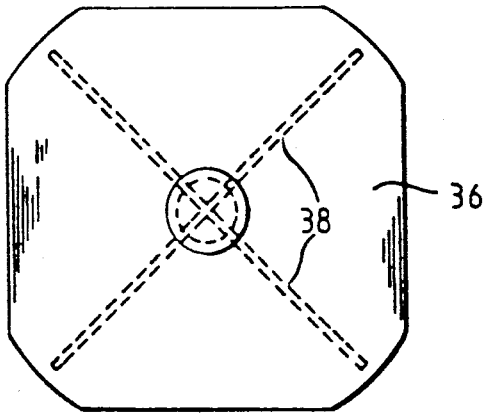

The skimmer illustrated in FIGS. 1 and 2 comprises a housing 10 within which a removable strainer basket 12 is interposed, in a central inlet cavity, between a high level inlet end 14 and a suction tube outlet 16. A principal connecting tube 18 extends right through the housing 10 and is adapted for connection, at one end, to the suction hose of a pool suction apparatus, such as an automatic pool cleaner, and at the other end to an inlet of a pool filtration system.

Figure 4:
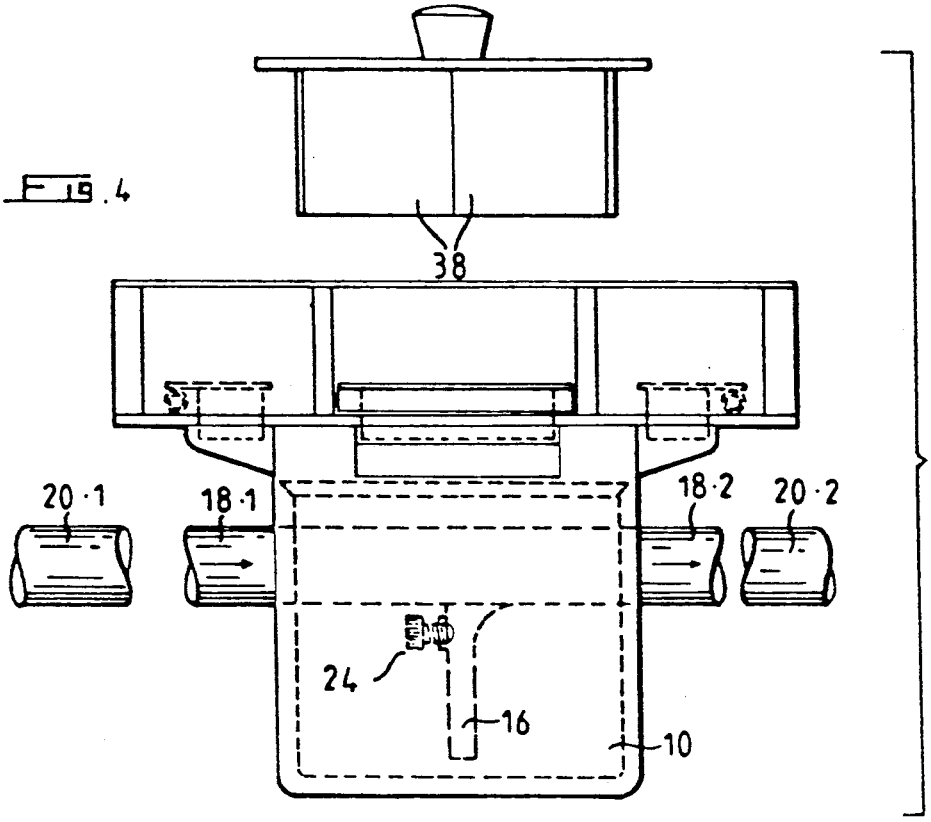

As can be seen from FIG. 4, the pool cleaner end 20.1 of a suction hose is connected to the inlet end 18.1 of the connecting tube 18 and the pump end 20.2 of the suction hose is connected to the outlet end 18.2 of the connecting tube 18. This results in a flow from left to right in the drawing which draws water out of the suction tube 16 to induce an outlet flow out of the housing 10, through the tube 16 and into the flow through the connecting tube 18. The induced flow in the suction tube 16 can be regulated by means of a manually operable regulator screw 24.

The suction tube 16, being located within the central cavity, but outside the strainer basket 12, draws water from the inlet end 14, through the strainer basket 12 and out into the connecting tube 18. Large items of debris will be trapped in the strainer 12, while small particles of debris will be allowed to flow, through the suction hose, to the principal filtration apparatus of the swimming pool.

Chambers 13 are provided in the body of the skimmer to receive pills of chlorine or other chemicals, which are released into the water depending on the rate of flow thereof through the skimmer.

It will be appreciated that other suction apparatus such as aperture plates or venturi arrangements could be used in place of the suction tube 16.

The skimmer is adapted to float by the provision of four flotation chambers 26 which, between them, define a plurality of intake ports 28, each closable by means of a float operated flap 30.

The buoyancy of the flotation chambers 26 is adjusted to impart to the skimmer a calculated degree of buoyancy, such that the intake ports extend, in use, a predetermined distance below the water line when the skimmer is afloat. The flaps 30 are pivoted at 34 and are adapted to close the intake ports 28 under the urging of floats 32, the buoyancy of which imparts a predetermined lift to the flaps 30 in use. The flaps 30 therefore act as height-adjustable weirs with the height of the weir varying in unison with the water level inside the skimmer—as the water level drops, the weir flaps 30 move inwardly to allow surface water to spill over the upper ends of the flaps 30. The buoyancy of the floats 32 ensure that a layer of surface water is spilt over the weirs, whereby surface debris will be collected effectively within the inlet cavity of the skimmer and therefore in the strainer basket 12.

The opposing streams of water entering the skimmer through the inlet ports 28 might cause an undesirable amount of turbulence and for this reason a combined cover and water deflector is provided (see FIGS. 3 and 4).

The cover 36 is provided with downwardly depending vanes 38 which obstruct the horizontal water flow from the intake ports 28 and direct the water flow downwardly into the strainer basket.

An alternative skimmer is illustrated in FIGS. 5 and 6 where the principal connecting tube 18.3 is adapted to drive an impeller of a turbine 38. The turbine 38 drives a rotor 40 which, in turn, draws water through the strainer basket 12.1 and expels it through exhaust ports 42 located low in the housing 10.1.

As a manufacturing option, the connecting tube 18 can either be disposed axially or angularly, with respect to the principal plan axes of the housing 10, as is shown in FIG. 7. The advantages of the axial connection 18.4 are to be found in that the skimmer tracks in line with the suction hose. If a more pronounced sideways sweeping action is required, the connecting tube can be located at an angle 18.5.

This drawing also illustrates the use of flexible wiper blades 44 which are resiliently mounted on either side of the float part of the housing and extend to below the waterline. The wiper blades are adapted to sweep debris off the sides of the pool, in use.

A flap arrangement according to the invention is shown in FIG. 8. In prior art flap arrangements, the flap leaves an area of dead space between the line 46 swept by the basket 12, upon removal thereof, and the inner extremities of the port cavity in each port 28). Any debris floating in this dead space will not be removed upon removal of with the basket 12.

This problem is obviated to a large extent in the arrangement of the invention as shown in FIG. 8 where the flap is constituted by a pivotable gate or plate 30.1 which is separate from a float 32.1 integral with a slidable plate 48 located in a slideway 50. The float 32.1 and plate 48 are free to move up and down in the slideway 50 to raise or lower the gate 30.1 and therefore to close or open the port 28. The line of closure formed by the plate 48 is much closer to the line of removal 46.1 of the strainer basket 12. The housing 10 is provided with an equalisation chamber 51 which is open to the interior of the housing 10 at 53 and open to the under side of the float 32.1 through an opening 55. This allows water to flow in under the float 32.1 to allow the rapid equalisation of the water level on either side of the plate 48.

Figure 9A:
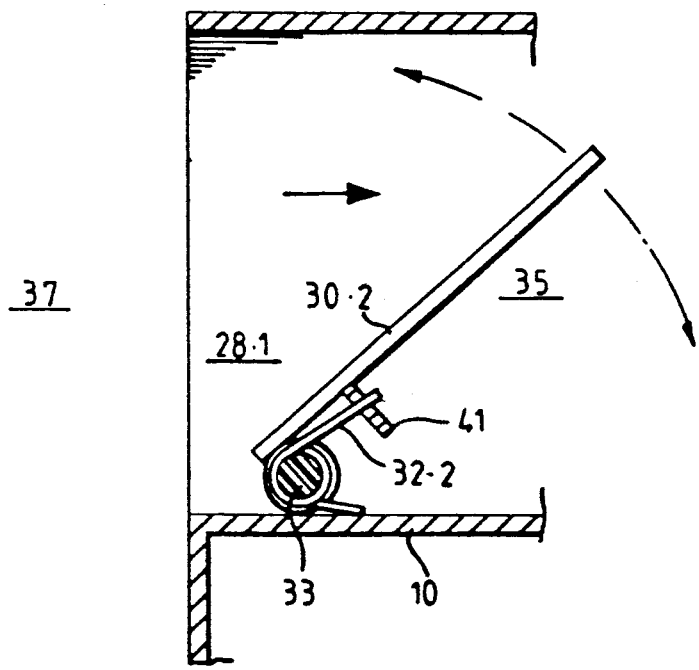
FIGS. 9 (*a*) and 9 (*b*) are diagrammatic sections of part of a skimmer according to the invention, illustrating the operation of two versions of a spring loaded weir gate.
Figure 9B:
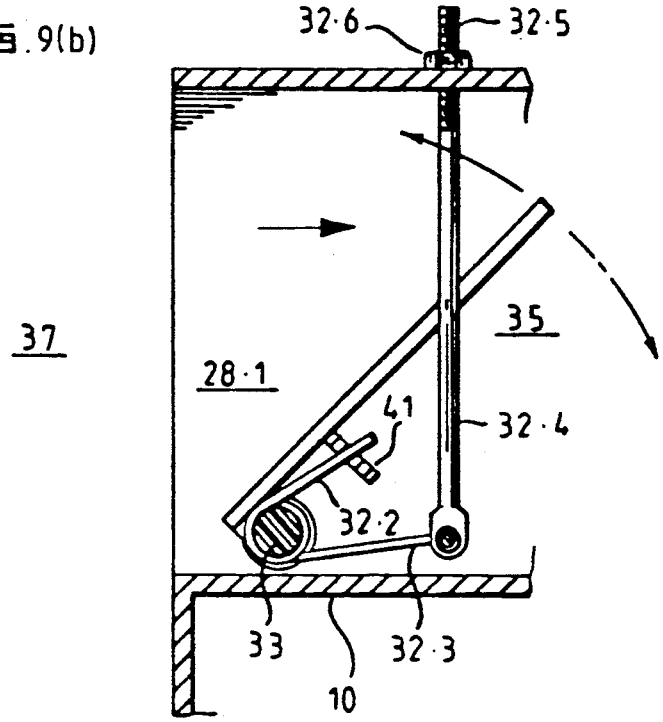

Instead of a float operated weir gate arrangement as illustrated in FIG. 8, the weir gate may be spring loaded as illustrated in FIG. 9 (*a*). In this embodiment the gate 30.2 is not float assisted. Instead the gate 30.2 is urged upwardly, under spring bias provided by a torsion spring 32.2. One arm of the spring 32.2 acts against the base or floor of the port 28.1 and the body of the spring 32.2 is located around the pivot pin 33 of the gate 30.2. The free arm of the spring 32.2 is secured to the rear of the gate 30.2 in such a manner that the gate 30.2 is urged to the position in which it closes the port 28.1, the closing force of the gate 30.2 can be controlled in such a manner that the appropriate pressure differential between the inside 35 and the outside 37 of the gate 30.2 will deflect the gate inwardly to spill the surface water over the edge of the gate to the inside 35 of the housing 10.

A stepped adjustment plate 41 is formed integrally with the gate 30.2. By adjusting the location of the free end of the spring 30.2 on the steps of the adjustment plate 41, the torque of the spring 32.2 can be increased or decreased. In this manner, the effective thickness of the layer of surface water which is allowed to spill over the edge of the gate 30.2, can be adjusted, assuming that the rate of withdrawal of water from the inlet cavity remains constant. Thus, the fact that the torque of the spring 32.2 can be varied allows the gate 30.2 to provide a metering function.

In the version of the weir gate arrangement illustrated in FIG. 9(*b*), the lowermost end 32.3 of the coil spring 32.2 is attached pivotally to an upright rod 32.4, the upper end 32.5 of which is threaded and extend through a hole in the upper portion of the housing 10. A nut 32.6 fitted to the threaded end of the rod allows its position relative to the housing 10 to be varied, so that the tension of the spring 32.2 can be increased or decreased as desired.

An alternative adjustment mechanism would be to provide the lowermost end of the spring 32.2 with a winding extension which extends out of the housing 10, the winding extension being securable, against the housing, in a plurality of positions, all of which represent different torque settings of the spring 32.2. The winding extension may be anchored against an adjustment plate similar to the adjustment plate 41 described above. Alternatively, the winding extension of the spring 32.2 could be connected to the movable part of a suitable adjustment mechanism, such as a fluid powered piston and cylinder arrangement, a solenoid, adjustable lever or the like.

Figures 11A, 11B, 11C:
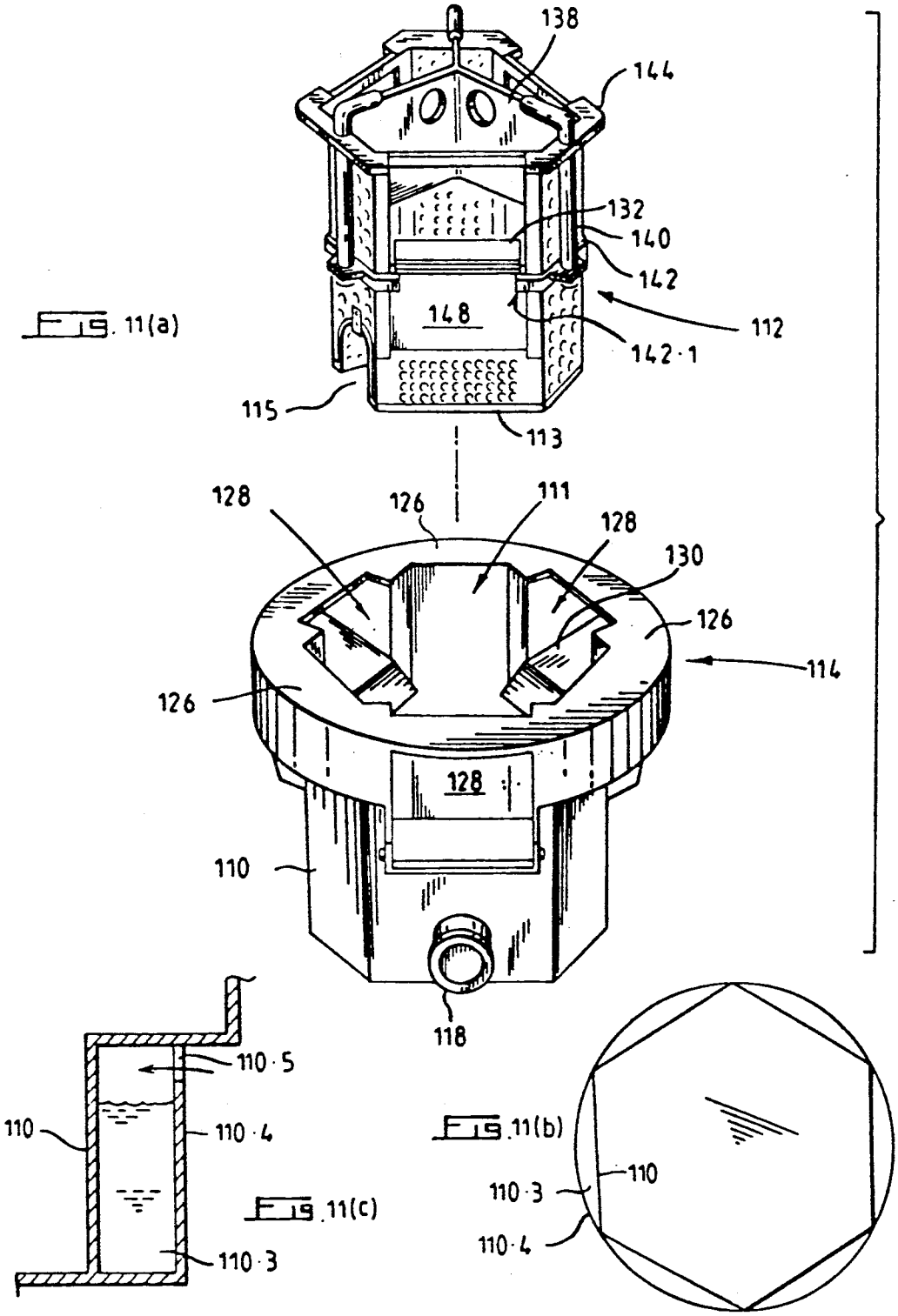
FIG. 11 (*a*) is an exploded isometric view of part of a pool skimmer according to the invention.
Figure 12:
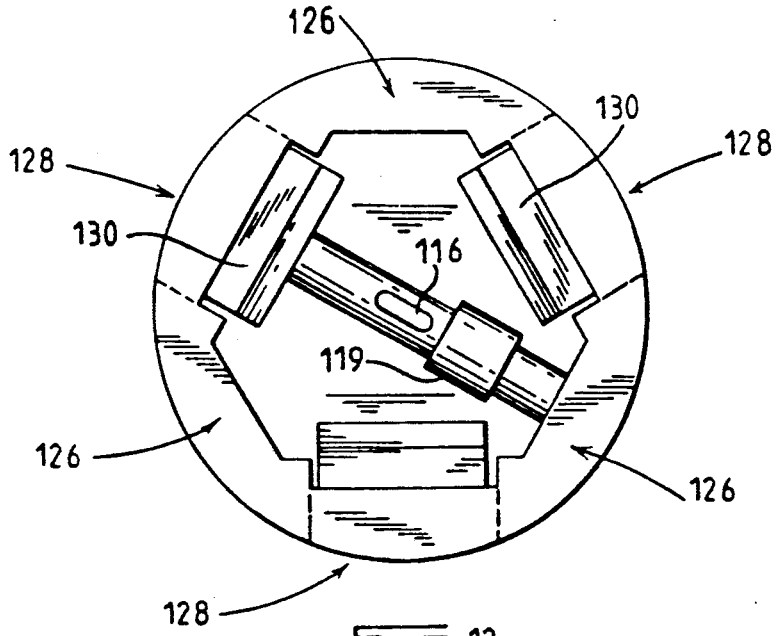
FIG. 12 is a plan view on the skimmer of FIG. 11, without the strainer basket.

The skimmer illustrated in FIGS. 11(*a*), 12 and 13 comprises a housing 110 within which an internal inlet cavity 111 is formed. A removable strainer basket 112 is adapted to be interposed between a high level inlet end 114 and a suction tube outlet 116 (which is visible in FIG. 12). A principal connecting tube 118 (also visible in FIG. 12) extends right through the housing 110 and is adapted for connection, at one end, to the suction hose of pool suction apparatus, and at the other end to an inlet of a pool filtration system. The water flow through the principal connecting tube 118 induces water flow in the suction tube outlet 116, effectively to draw water out of the inlet cavity 111 and into the connecting tube. A sliding cover 119 can be slid at least partially over the suction outlet 116 in order to regulate the suction at this point.

The suction outlet 116, being located outside the strainer basket in a tube tunnel 115 formed in the base of the strainer basket 112, draws debris-laden water from the inlet cavity 111, through the strainer basket 112 and out into the connecting tube 118. The strainer basket 112 will, in time, fill up with debris which can be removed from the top of the basket. For the sake of convenience, however, the base 113 of the basket can be unhinged to open the entire bottom of the basket 112.

The base 113 and the tunnel cover 117 integral therewith can be hinged clear of the bottom of the strainer basket 112 by loosening a retaining clip 119.

The skimmer is provided with a float ring in which three flotation chambers or compartments 126 are provided. A buoyant material, such as a closed cell foam, may be located within each of the three chambers 126 and the buoyancy of the flotation chambers 126 may be adjusted to impart to the skimmer a calculated degree of buoyancy.

The flotation chambers define, between them, three intake ports 128 each of which is closeable by means of a float operated weir gate arrangement, which will be described in greater detail below.

The skimmer floats, in use, such that the intake ports extend a predetermined distance below the water line when the skimmer is afloat. FIGS. 11(*b*) and 11(*c*) illustrate a modification of the skimmer which is not shown in FIG. 11(*a*). According to this modification, ballast chambers 110.3 are formed against the wall 110 of the skimmer housing. The chambers are formed between the hexagonal inner wall 110 and a circular outer wall 110.4 so that the lower portion of the skimmer housing has a circular outline, as shown by FIG. 11(*b*). The ballast chambers 110.3 are closed at their lower ends and are provided with an open slot 110.5 at their upper ends to allow the chambers to be substantially filled with water in use. The effect of this is that sudden movements of the skimmer are damped, and the skimmer body is inhibited from jumping out of the water if the water flow through the skimmer is suddenly interrupted. If the skimmer is used in other liquids than water, the effect of the ballast chambers will be the same, since they become filled, in use, with the same liquid as that in which the skimmer is floating.

Figure 13:
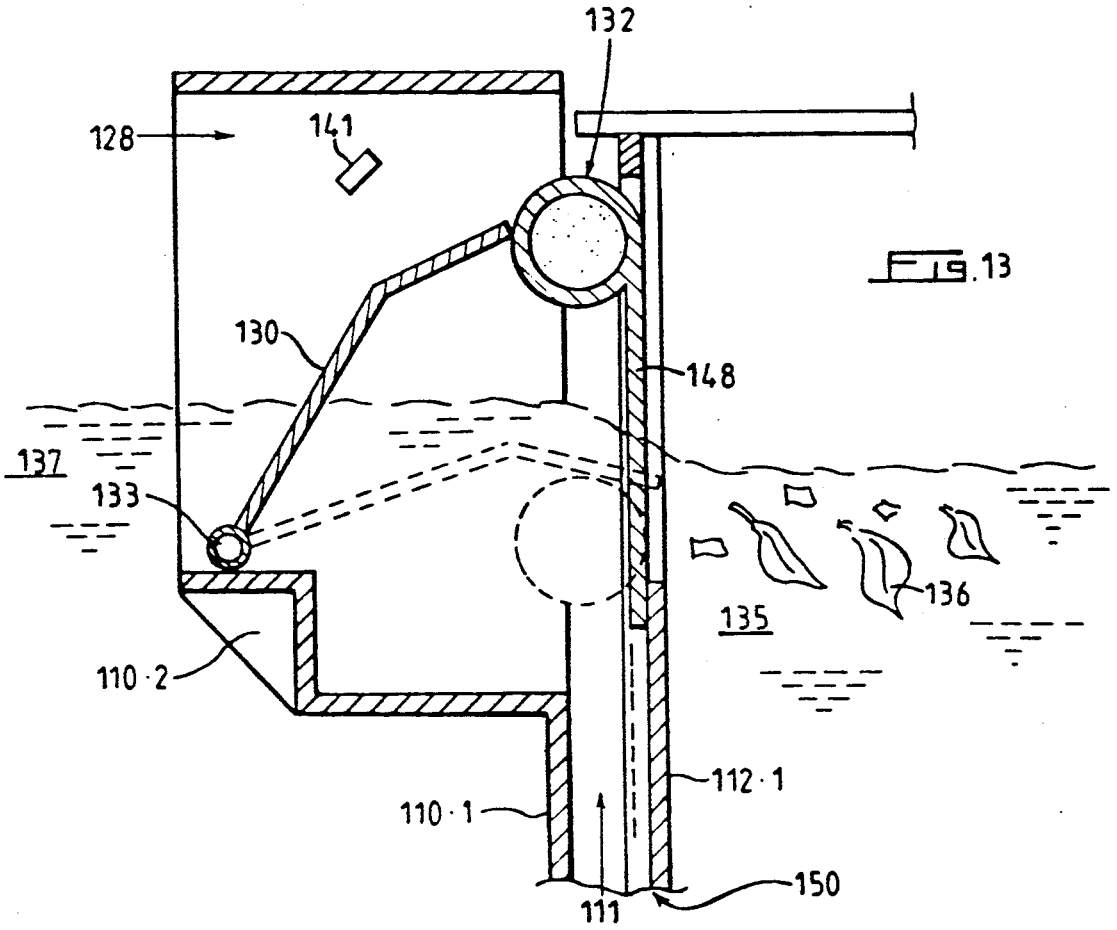
FIG. 13 is a detailed section on a float operated weir forming part of the skimmer of FIGS. 11 and 12.

The float operated weir gate arrangement is illustrated in FIG. 13 where the one wall 112.1 of the strainer basket 112 can be seen adjacent the interior wall 110.1 which defines the inlet cavity 111 within the housing 110. As can be seen both from FIG. 11 and from FIG. 13, a part of the float operated weir arrangement is constituted by a float 132 which is mounted on a plate 148 slidable within a slideway 150 carried on the outer wall 112.1 of the strainer basket 112.

A control gate is pivoted to the side walls 110.2 of the inlet port 128 and the free end thereof bears downwardly, on the upper surface of the float 132. The interior of the float is filled with a buoyant material, the quantity of which may be varied to increase or decrease the floatability of the float 132, whereby the thickness of the layer of water spilling over the edge of the gate 130 may be controlled. The gate 130 is allowed to pivot, on a pivot pin 133 between an upper most stop position against a stop formation 141, through an intermediate position, which is shown in solid outline in FIG. 13, where the float 132 is at its highest position (when all suction at the suction outlet 116 is terminated), to a lower position, shown in dotted outline in FIG. 13, in which the float 132 is at its operating position.

In use, the suction within the inlet cavity 111, created by the suction outlet 116, tends to create a differential in the water levels outside 137 and inside 135 the inlet cavity 111. (With the gate 130 in the position shown in dotted outline in FIG. 13). As a result of the closing action imparted to the gates 130 by the floats 132, the gates 130 tend to rise and fall with the changing water level differential partially to occlude the inlet ports 128. The effect is that the surface water outside the gates 130 cascades over the free ends of the gates 130 and into the inlet cavity and strainer basket 112, the outline of which is complemental to the internal shape of the inlet cavity 111, carrying any floating debris 136 with it. Once inside the strainer basket 112, the floating debris is retained by the suction within the inlet cavity 111 and the closing action of the gate floats 132 and plates 148.

The plates 148 are free to move up and down in the slideways 150.

To remove the strainer basket 112 from the inlet cavity 111, a set of handles 138 is provided (the handles are not illustrated in FIG. 13 for the sake of clarity). The handles 138 take the form of downwardly depending vanes which obstruct the horizontal water flow from the intake ports 128 and direct the water flow downwardly into the strainer basket 112. The outer ends of the vanes are connected to downwardly depending rods 140 which are secured, at their lower ends, to brackets which curve inwardly (at 142.1) under the floats 132. The rods 140 are slidable within the rim 144 of the strainer basket so that, upon withdrawal of the strainer basket from the inlet cavity 111, the handle vanes are drawn clear of the water surface, at least partly, and the rods 140 are drawn upwardly so that the brackets 142.1 engage the underside of the floats 132.

Upon cessation of suction, that is when the pool filtration system is stopped, the water level differential between the inside 135 and the outside 137 of the gates 130 disappears rapidly, so that the floats 132 float upwardly to their upper most position, as illustrated in solid outline in FIG. 13. It is at this point that the handle brackets engage the underside of the floats 132 whereby the floats 132 are retained in their uppermost position and the plates 148 are kept closed. This ensures that surface debris 136 retained within the strainer basket 112 is not lost during withdrawal of the strainer basket 112.

It is possible to provide a simple locking mechanism by means of which the floats 132 or the plates 148 may merely be locked, manually, in the closed position for removal and replacement of the strainer basket 112 from the inlet cavity 111.

In use, as can be seen from FIG. 10, the skimmer 52 is located in-line in the suction hose 54 of a suction operated pool cleaner 56. The suction hose is connected, at 58, to the suction inlet of a pool filter and pump arrangement 60 which returns the pool water to the pool via a return line 62. As the pool cleaner 56 moves around along the bottom of the pool, it drags the skimmer 52 along with it. Water is drawn off the surface of the pool and into either the flow in the hose 54 or into the pool itself (depending on whether the induced flow or the turbine apparatus is being used) and leaves and other debris are trapped in the strainer basket. As soon as the water flow through the skimmer unit stops, such as when the pump 60 stops, the water level within the skimmer 52 will equalise with the level outside the unit. This will result in closure of the inlet ports by the gates, thereby preventing the outflow of entrapped debris.

In industrial or agricultural applications, where the water level within the pool or pond may vary considerably, the skimmer housing 110 may be ballasted by means of a ballast mass 160 which is secured to the underside of the housing 110 by means of a system of ropes 162 and pulleys 164. The entire assembly may be anchored to the bottom of the pool or pond by mean of an anchor mass 166, the ballast mass system 160 ensuring that the rope 162 is appropriately adjusted in length to retain the skimmer housing 110 in a predetermined floating position relative to the surface of the water, even when the water level rises or falls.

In connecting the skimmer housings to a suction line, a series of in-line arrangements may be used as is shown in FIG. 15 where a plurality of skimmer housings 110 are connected behind one another to the same suction hose 154. Alternatively, the skimmer housings may be connected in parallel as is shown in FIG. 16 where the skimmer housings 110 branch off, on flexible suction hose sections 154.1 which are secured to branches of a main suction line 154.2.

Figure 17:
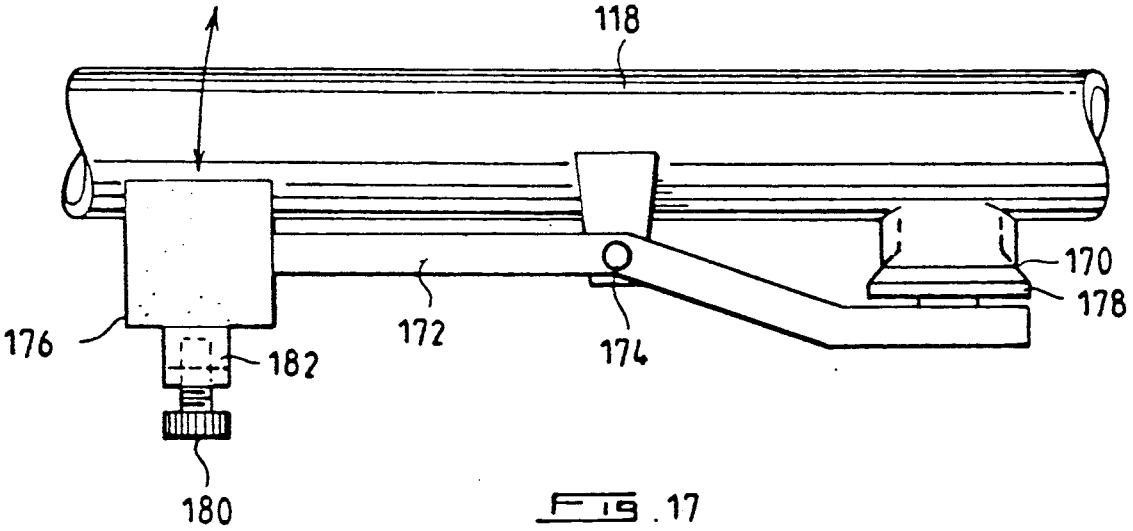
FIG. 17 illustrates an automatic shut-off valve for use with skimmers of the invention.

FIG. 17 shows an automatic shut-off valve for use with skimmers of the invention. The principal connection tube 118 is provided with a valve 170 which is automatic in operation. An arm 172 is pivoted at 174 to the connection tube 118 and has a pair of floats 176 mounted on a bracket 182 at one end, which straddle the tube 118. At the other end of the arm 172 is a resilient valve member 178. When the water level within the interior of the skimmer is sufficiently high, the floats 176 move upwards, above the position shown in FIG. 17, opening the valve 170 and allowing liquid flow through the valve. If the water level in the skimmer housing drops, the floats fall to the position illustrated in FIG. 17, causing the resilient valve member 178 to seal the valve 170, and thus shutting off the flow of liquid through the skimmer. This prevents air from being drawn into the pool filtration circuit in case of the intake ports of the skimmer being blocked by large floating objects, for example. An adjustment screw 180 is provided in a threaded hole located centrally in the bracket 182 carrying the floats 176, and its end bears against the bottom of the tube 118 when the floats are lifted by water in the skimmer housing. By varying the position of the screw 180, the opening of the valve 170 and thus the rate of flow of water therethrough can be adjusted.

I claim:

1. A pool surface skimmer for the removal of floating debris from a top surface of a pool of liquid, the skimmer comprising a buoyant housing having a central cavity defined therein, said housing having a high level inlet in fluid communication with said top surface of said pool of liquid and said central cavity, and a low level outlet within said central cavity; a strainer within said central cavity interposed between said high level inlet and said low level outlet; a flow inducing means in fluid communication with said low level outlet so that a flow of fluid within said flow inducing means induces a flow through said low level outlet and said central cavity to draw liquid and debris from said high level inlet through said strainer and through said low level outlet so that large items of debris are trapped in the strainer while small particles of debris pass through said low level outlet; at least two flotation chambers within said housing to provide buoyancy to said housing and position said high level inlet immediately below said surface of said pool of liquid; at least one intake port, defined by said flotation chambers and said housing, in fluid communication with said high level inlet and said surface of said pool of liquid; and at least one gate connected to said housing and positioned across said intake port to regulate the flow of liquid through said intake port and into said high level inlet, said gate being biased towards closing off said intake port and yet allowing the ingress of the liquid, from the top surface of said pool of liquid, into said high level inlet upon the inducement of flow, by the flow inducing means, through said low level outlet, the gate including at least one plate that is slidable in a slideway formed in the housing adjacent to the high level inlet, and wherein at least one buoyant float is connected to said plate to bias the gate towards closing off the intake port, the buoyancy of the buoyant float being adjustable to allow the ingress of the liquid, from the top surface of the pool of liquid, into said high level inlet upon the inducement of flow, by the flow inducing means, through the low level outlet.

2. A pool surface skimmer according to claim 1 wherein the gate includes at least one plate that is slidable within at least one slideway formed within the strainer, and wherein at least one buoyant float is connected to said plate to bias the gate towards closing off the intake port, the buoyancy of the buoyant float being adjustable to allow the ingress of the liquid, from the top surface of the pool of liquid, into said high level inlet upon the inducement of flow, by the flow inducing means, through the low level outlet.

3. A pool surface skimmer according to claim 2 wherein the strainer is removable and wherein means are provided to close the gate, and to maintain the gate closed, when the strainer is withdrawn from and replaced in the inlet cavity.

4. A pool surface skimmer according to claim 3 wherein the closing means for the gate includes handles for the strainer that are connected to the gate in such a manner that the gate is retained in a closed position when the handles are drawn upwardly.

5. A pool surface skimmer according to claim 1 wherein the gate includes a cover plate which is pivoted at its base so that a free end of said cover overlies the buoyant float, the control plate impinging on the float operated gate, under urging of liquid passing over the control plate to ingress the high level inlet.

* * * * *